US010578325B2

(12) United States Patent
McDonnell et al.

(10) Patent No.: US 10,578,325 B2
(45) Date of Patent: Mar. 3, 2020

(54) HUMIDIFIER WITH WATER FLOW CONTROL BETWEEN AN UPPER TANK AND A LOWER RESERVOIR

(71) Applicants: Joseph A. McDonnell, Miramar, FL (US); Dung Tran, Miramar, FL (US)

(72) Inventors: Joseph A. McDonnell, Miramar, FL (US); Dung Tran, Miramar, FL (US)

(73) Assignee: Great Innovations, LLC, Miramar, FL (US)

( * ) Notice: Subject to any disclaimer, the term of this patent is extended or adjusted under 35 U.S.C. 154(b) by 293 days.

(21) Appl. No.: 14/950,345

(22) Filed: Nov. 24, 2015

(65) Prior Publication Data

US 2016/0146490 A1 May 26, 2016

Related U.S. Application Data

(60) Provisional application No. 62/084,094, filed on Nov. 25, 2014.

(51) Int. Cl.

| | |
|---|---|
| ***F24F 6/12*** | (2006.01) |
| ***F24F 6/02*** | (2006.01) |
| ***F24F 11/00*** | (2018.01) |
| *F24F 6/00* | (2006.01) |
| *H01H 35/18* | (2006.01) |
| *B05B 17/06* | (2006.01) |

(52) U.S. Cl.

CPC ..... *F24F 6/12* (2013.01); *F24F 6/02* (2013.01); *F24F 11/0008* (2013.01); *B05B 17/0676* (2013.01); *F24F 2006/008* (2013.01); *H01H 35/18* (2013.01)

(58) Field of Classification Search

CPC ... B05B 17/0676; F24F 2006/008; F24F 6/12; F24F 11/0008; F24F 6/02; H01H 35/18

See application file for complete search history.

(56) References Cited

U.S. PATENT DOCUMENTS 1,718,389 A * 6/1929 Spaulding ..... F24F 6/04 236/44 A
1,775,020 A * 9/1930 Liautaud ..... H01H 35/18 200/84 R
1,801,303 A * 4/1931 Brand ..... G01F 23/60 200/50.36

(Continued)

FOREIGN PATENT DOCUMENTS

WO WO-2004041410 A2 5/2004

OTHER PUBLICATIONS

Parker "Solenoid valves" published Jun. 2006 (hereafter Parker).*

(Continued)

*Primary Examiner* — Stephen Hobson
(74) *Attorney, Agent, or Firm* — Bass, Berry & Sims, PLC

(57) ABSTRACT

The humidifier has an upper tank and a lower reservoir. A liquid level switch in the lower reservoir works in conjunction with a valve in a water passage between the upper tank and the lower reservoir in order to provide an automated flow of water to the lower reservoir during operation of the humidifier. The upper tank is unsealed, such that air in the upper tank may equalize with an ambient air pressure. The humidifier can be top-filled allowing that the upper tank to be permanently affixed to the base of the humidifier.

12 Claims, 9 Drawing Sheets

(56) References Cited

U.S. PATENT DOCUMENTS 2,570,451 A * 10/1951 Hottenroth ..... G05D 9/12 236/44 A
3,640,265 A 2/1972 Swart, Sr.
4,139,762 A * 2/1979 Pohrer ..... F24F 6/18 126/113
4,644,790 A * 2/1987 Mizoguchi ..... G01F 23/02 261/119.1
4,646,630 A 3/1987 McCoy et al.
4,752,422 A * 6/1988 Uchida ..... A61L 9/122 239/58
4,757,305 A * 7/1988 Peso ..... G01F 23/60 116/110
4,820,453 A * 4/1989 Huang ..... B05B 17/0615 261/26
4,841,122 A * 6/1989 Marton ..... F24F 6/025 392/327
5,108,663 A * 4/1992 Chiu ..... F24F 6/043 261/107
5,275,044 A * 1/1994 Riley ..... G01F 23/68 338/33
5,519,900 A * 5/1996 Gardner ..... E03D 1/003 4/353
5,702,648 A 12/1997 White et al.
5,916,490 A * 6/1999 Cho ..... C02F 1/4602 210/748.01
6,259,860 B1 * 7/2001 Chen-Lung ..... F24F 6/00 392/403
6,394,427 B1 * 5/2002 Guetersloh ..... F24F 6/02 261/106
6,793,205 B2 * 9/2004 Eom ..... F24F 6/12 261/142
6,998,552 B1 * 2/2006 Li ..... G01F 23/706 200/310
7,066,452 B2 6/2006 Rotering et al.
7,182,321 B2 * 2/2007 Huang ..... F24F 6/00 261/66
7,362,037 B2 * 4/2008 Kang ..... B05B 17/0615 310/341
8,430,115 B2 4/2013 Stieb
8,763,994 B2 * 7/2014 Seremetis ..... B05B 17/0615 261/119.1
9,574,927 B2 * 2/2017 Milone ..... H01H 35/18
9,593,860 B1 * 3/2017 Robinson ..... F24F 11/0008
2002/0089075 A1 7/2002 Light et al.
2004/0108604 A1 * 6/2004 Pan ..... F24F 6/00 261/26
2007/0152356 A1 * 7/2007 Huang ..... F24F 6/00 261/81
2010/0258958 A1 * 10/2010 Wong ..... F24F 6/04 261/38
2011/0200452 A1 * 8/2011 Noel ..... F04B 49/025 417/44.1
2013/0300005 A1 * 11/2013 Hou ..... F24F 6/12 261/24

OTHER PUBLICATIONS

"Switch" Wikipedia published Oct. 27, 2013 accessed at <https://en.wikipedia.org/w/index.php?title=Switch&oldid=579003770> (Year: 2013).*
"Service Manual for Aprilaire Humidifier," http://www.aprilaire.com/ftp://ftp.aprilaire.com/Fulfillment/Humidifiers/Complete1780.pdf (Accessed Dec. 22, 2014).

* cited by examiner

FIG. 1
(CONVENTIONAL)
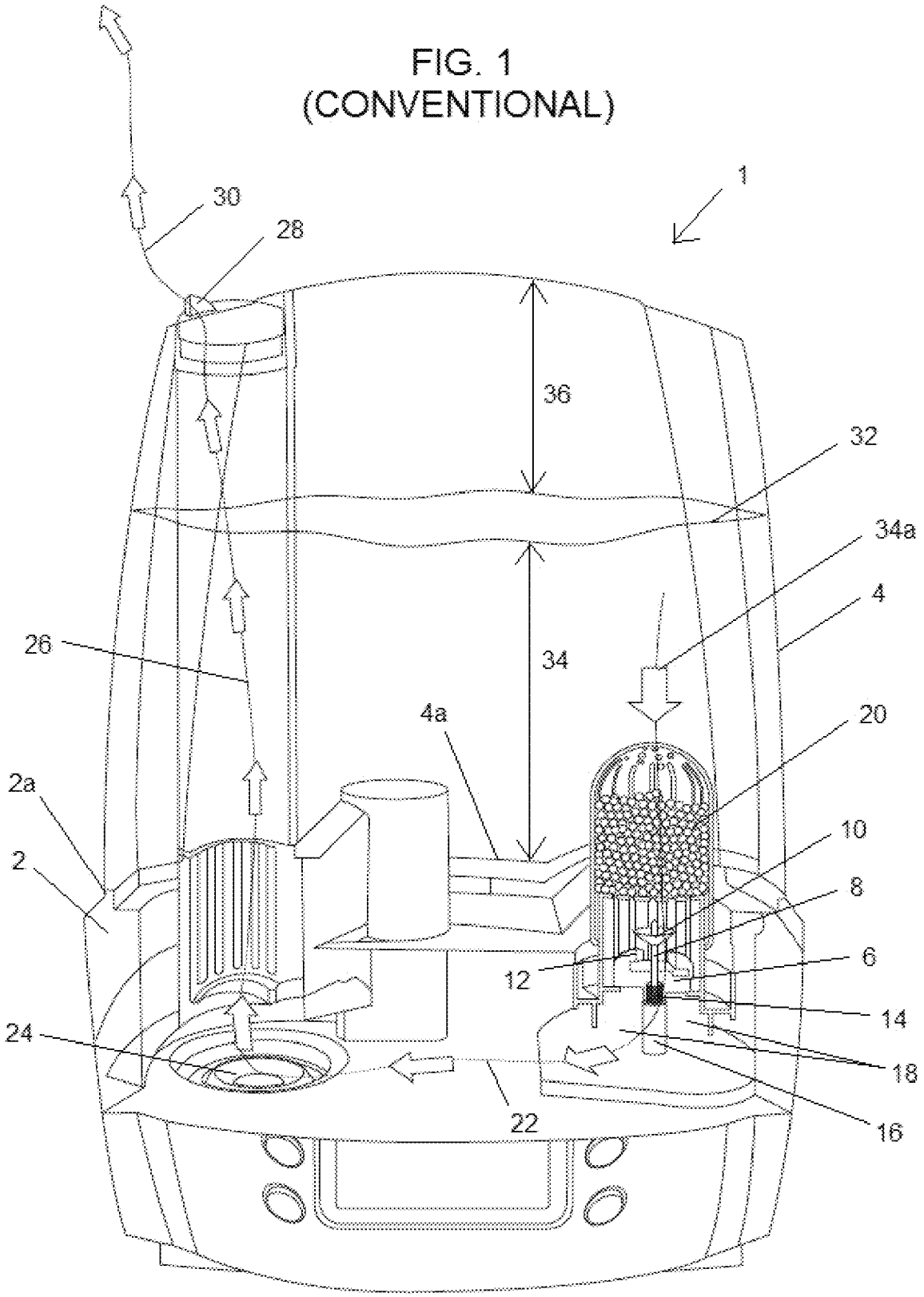

HUMIDIFIER WITH WATER FLOW CONTROL BETWEEN AN UPPER TANK AND A LOWER RESERVOIR

PRIORITY STATEMENT

This application is a non-provisional application that claims priority to U.S. Provisional Application No. 62/084,094, filed on Nov. 25, 2014, the entire contents of which is incorporated by reference in its entirety.

BACKGROUND OF THE INVENTION

Field of the Invention

Example embodiments relate generally to a humidifier, and more specifically to a humidifier utilizing a switch in a lower reservoir in communication with a valve in a water passage between an upper tank and the lower reservoir in order to provide water flow control to the lower reservoir.

Related Art

A humidifier is a device that may be used to increase moisture (humidity) in a controlled area or environment such as a room of a building or a house. However, conventional humidifiers are known to suffer from problems that may include water spillage and general inconvenience associated with removing the tank and carrying it from one location to another location to fill the humidifier with water which the humidifier converts to vapor or steam.

As shown in FIG. 1, a conventional humidifier 1 often includes a base 2 with a detachable upper water tank 4. The upper water tank 4 may be filled with water by pulling the detachable upper water tank 4 off of the base 2 and carrying the tank 4 to a water source such as a spigot. In particular, the tank 4 may be turned upside down, and a tank cap 6 may be unscrewed from the tank 4, allowing the tank 4 to be filled with water until the tank 4 is generally full. The tank cap 6 may then be re-sealed by screwing cap 6 back onto tank 4 and returning tank 4 to an upright position as tank 4 is re-mounted onto base 2.

Once tank 4 is remounted onto base 2, valve components within cap 6 may engage base 2 to allow water 34 to fill a lower reservoir 18 of humidifier 1. Specifically, a post 16 mounted to base 2 may contact a distal end of a valve stem 8, causing stem 8 to be thrust upward as the weight of tank 4 rests onto base 2. The upward movement of valve stem 8 causes spring 14 to become compressed (whereas decompression of spring 14 causes the valve to be forced into a closed position when tank 4 is removed from base 2, as described herein). Upward movement of stem 8 also causes valve disk 10 to disengage from valve seat 12, allowing an opening (between disk 10 and seat 12) for a flow of water 34*a* to move from tank 4 to the lower reservoir 18. Optionally, a filter 20 may clean this flow of water 34*a* as it passes into lower reservoir 18. Gravity may then allow a flow of water 22 from reservoir 18 to ultrasonic nebulizer 24, where the nebulizer 24 then energizes and vaporizes the water into a stream of vapor or steam 26 that may exit humidifier via connection 28 in order to produce a vapor stream 30 into a room.

Based on the understanding above, it is important to note that during the operation of the humidifier 1, the water 34 in tank 4 is actually held in the tank by a vacuum force that is created in the trapped air space 36 that exists above a liquid level 32 of tank 4. That is to say, as nebulizer 24 vibrates water 22 into vapor 26 and the flow of water 34*a* continues to replenish a water supply within reservoir 18, the only appreciable force that counteracts the water 34 in tank 4 from flooding reservoir and overflowing the entire base 2 is the vacuum pressure that exists in this trapped air space 36 above liquid level 32. Therefore, if the integrity of tank 4 were somehow compromised and upper air space 36 of tank 4 were allowed to freely exchange air with the ambient air around humidifier 1, the water 34 in tank 4 would immediately drop into reservoir 18 and flood base 2 causing water to escape at the seam between the bottom end 4*a* of tank 4 and the top end 2*a* of base 2, causing significant water spillage.

Furthermore, the nature of the detachable tank 4 and valve components of the tank cap 6 may cause inconvenience, water spillage, and undue wear that may cause humidifier 1 to be less durable and enjoy a shorter useable life span. For instance, the tank 4 must necessarily be rather large in order to allow the humidifier to operate for a length period such as overnight. A large tank 4 is often inherently difficult to fill at a normal spigot due to a lack of clearance space under the spigot, especially when a normal-sized bathroom sink is used to fill the tank 4. This, in and of itself, is inconvenient, as a person filling tank 4 may be forced to lean over a bathroom tub and use a bathroom tub spigot to fill the tank 4, or trek for long distances through the person's home to use a kitchen sink with less clearance constraints. Additionally, the weight associated with carrying a large tank 4 may be overly burdensome, especially for elderly or very young users of the humidifier. Further, the detachable nature of tank 4 necessitates valve components within cap 6 in order to seal and re-open a water passage to allow water flow into lower reservoir 18, and these valve components are particularly susceptible to wear. For instance, if tank 4 is dropped or allowed to fall with any appreciable amount of force onto post 16 of base 2, valve piston 8 and/or valve disk 10 may become bent and/or permanently damaged, and spring 14 may be permanently deformed. If any of this damage were to occur, spring 14 and/or piston 8 may become unable to return disk 10 to a closed position against seat 12, which would cause significant water spillage as tank 4 is filled in an upside down configuration and then flipped over to be oriented in a right-side up position as tank 4 is placed back onto base 2 (i.e., the spillage would occur when tank 4 is in the right-side up position). Furthermore, damage to valve piston 8, valve disk 10, and/or valve seat 10 may cause valve disk 10 to become unable to separate from valve seat 12, causing humidifier 1 to no longer function at all, as water flow 34*a* would be unable to reach reservoir 18.

SUMMARY OF INVENTION

At least one embodiment relates to a humidifier.

In one embodiment, the humidifier includes a passage fluidly connecting an upper tank to a lower reservoir; a switch in the lower reservoir, the switch configured to measure a liquid level in the lower reservoir; and a valve in the passage, the valve being configured to open if the switch indicates a low liquid level in the lower reservoir and close if the switch indicates a high liquid level in the lower reservoir.

In one embodiment, the upper tank is unsealed such that air in the upper tank is allowed to equalize with an ambient air pressure.

In one embodiment, the upper tank is permanently affixed to a base of the humidifier.

In one embodiment, the humidifier is top-filled such that the upper tank is configured to accept water from a top connection on the upper tank.

In one embodiment, the humidifier includes an electrical circuit between the valve and the switch; and a power source capable of energizing the electrical circuit, the switch being configured to change an energy state of the electrical circuit in order to open the valve if the switch indicates the low liquid level in the lower reservoir.

In one embodiment, the switch is a float switch capable of floating within the lower reservoir, the float switch being configured to change the energy state of the electrical circuit in order to open the valve if the float switch floats to a position that is the low liquid level in the lower reservoir.

In one embodiment, the switch is a conductive post with at least one electrical contact, the at least one electrical contact being configured to change the energy state of the electrical circuit in order to open the valve if a water level in the lower reservoir is at the low liquid level.

In one embodiment, a first electrical contact, of the at least one electrical contact of the conductive post, is positioned near a top portion of the conductive post, a height of the top portion of the conductive post corresponding to the high liquid level of the lower reservoir.

In one embodiment, the valve is a solenoid valve.

In one embodiment, the solenoid valve is one of a plunger solenoid valve and a pivoting-armature solenoid valve.

In one embodiment, the upper tank is detachable from the remainder of the humidifier.

In one embodiment, the switch is configured to measure a spectrum of liquid levels in the lower reservoir, wherein the valve is further configured to open to one of a spectrum of positions between fully-opened and fully-closed based on the measurement of the spectrum of liquid levels from the switch.

BRIEF DESCRIPTION OF THE DRAWINGS

The above and other features and advantages of example embodiments will become more apparent by describing in detail, example embodiments with reference to the attached drawings. The accompanying drawings are intended to depict example embodiments and should not be interpreted to limit the intended scope of the claims. The accompanying drawings are not to be considered as drawn to scale unless explicitly noted.

FIG. 1 is a conventional humidifier;

DETAILED DESCRIPTION

Figure 2:
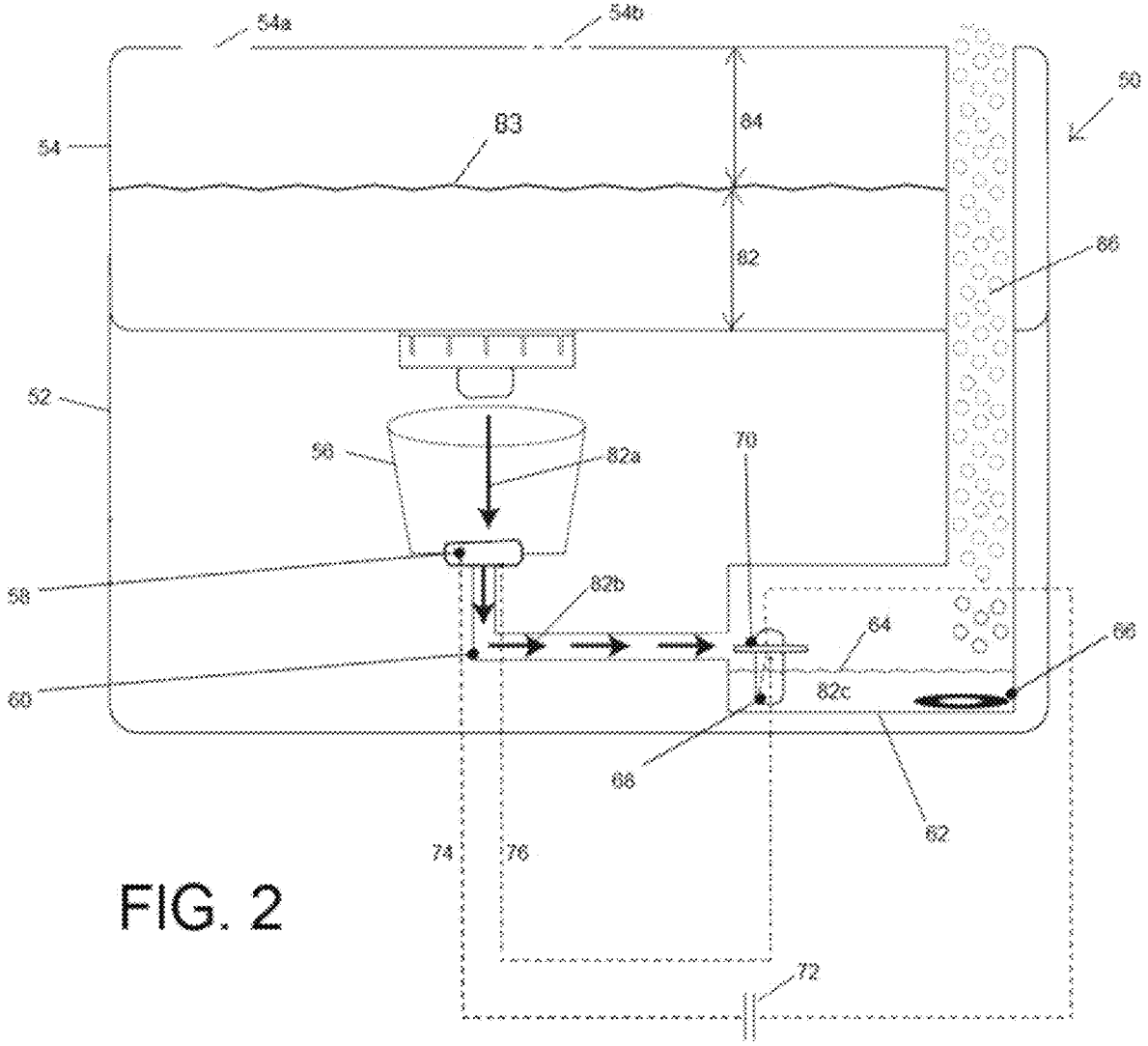
FIG. 2 is a diagram of a humidifier, in accordance with an example embodiment.

Detailed example embodiments are disclosed herein. However, specific structural and functional details disclosed herein are merely representative for purposes of describing example embodiments. Example embodiments may, however, be embodied in many alternate forms and should not be construed as limited to only the embodiments set forth herein.

Accordingly, while example embodiments are capable of various modifications and alternative forms, embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives falling within the scope of example embodiments. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments. As used herein, the term "and/or" includes any and all combinations of one or more of the associated listed items.

It will be understood that when an element is referred to as being "connected" or "coupled" to another element, it may be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between", "adjacent" versus "directly adjacent", etc.).

The terminology used herein is for the purpose of describing particular embodiments only and is not intended to be limiting of example embodiments. As used herein, the singular forms "a", "an" and "the" are intended to include the plural forms as well, unless the context clearly indicates otherwise. It will be further understood that the terms "comprises", "comprising,", "includes" and/or "including", when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

FIG. 2 is a diagram of a humidifier 50, in accordance with an example embodiment. The humidifier may have an upper water tank 54 that is attached to a base 52. The tank may be permanently affixed to the top of the base 52 with an opening 54*a* that allows the tank 54 to be filled with water 82. The opening 54*a* may be wide enough to allow a pitcher, a distilled water bottle/jug, or a large bucket to fill the tank 54*a* (i.e., the opening 54*a* may be relatively large to facilitate easy filling). The tank 54 may also optionally be detachable from the base 52 to allow the tank 54 to be cleaned or filled and carried back to the base 52.

The tank 54 may also be open to ambient air. Therefore, air 84 above the liquid level 83 may have an air pressure that is equalized with ambient (atmospheric) air. This may be accomplished by allowing opening 54*a* to remain open at all times. Alternatively, vents or slits 54*b* may be provided on the tank 54.

The humidifier 50 may function by allowing a flow of water 82*a* from the tank 54 to pass into a channel 56 that directs the water flow 82*a* to a valve 58. The valve may be an automatic open/close valve that is activated by the opening and closing of an electrical circuit (described herein in more detail). For instance, the valve 58 may be a solenoid valve. In the event a solenoid valve is used, the solenoid may be either a plunger-type or a pivoting-armature type solenoid valve.

A lower reservoir 62 of the humidifier 50 may hold water 82*c* that is vaporized by a nebulizer 66 (such as an ultrasonic nebulizer) that discharges water vapor 86. As a liquid level 64 of reservoir 62 drops (following a period of use by nebulizer 66), a sensor switch 68 with a floater 70 (made from a floating material, such as extruded polystyrene foam) may drop in concert with the liquid level 64. As the float switch 68 drops (as the reservoir 62 is at a "low" liquid level 64), the switch 68 may close a first electrical circuit 76 (where the first electrical circuit 76 may electrically connect valve 58 to a power source 72 such as a DC power source, as shown in more detail in FIG. 3). In closing the first electrical circuit 76, an overall electrical circuit 74/76 may become energized (see a second electrical circuit 74 electrically connecting valve 58 to the power source 72), causing valve 58 to in turn become actuated to an open (energized) position. In the open position, valve 58 allows a flow of water 82*b* to be released from channel 56 through tube 60 and into reservoir 62 in order to fill the reservoir 62. As reservoir 62 fills with water 82*c*, the elevation of switch 68 rises (via float 70), and the electrical circuit 76 is opened (when the reservoir 62 is at a "high" liquid level). By opening circuit 76, valve 58 becomes de-energized, causing valve 58 to close.

Figure 3:
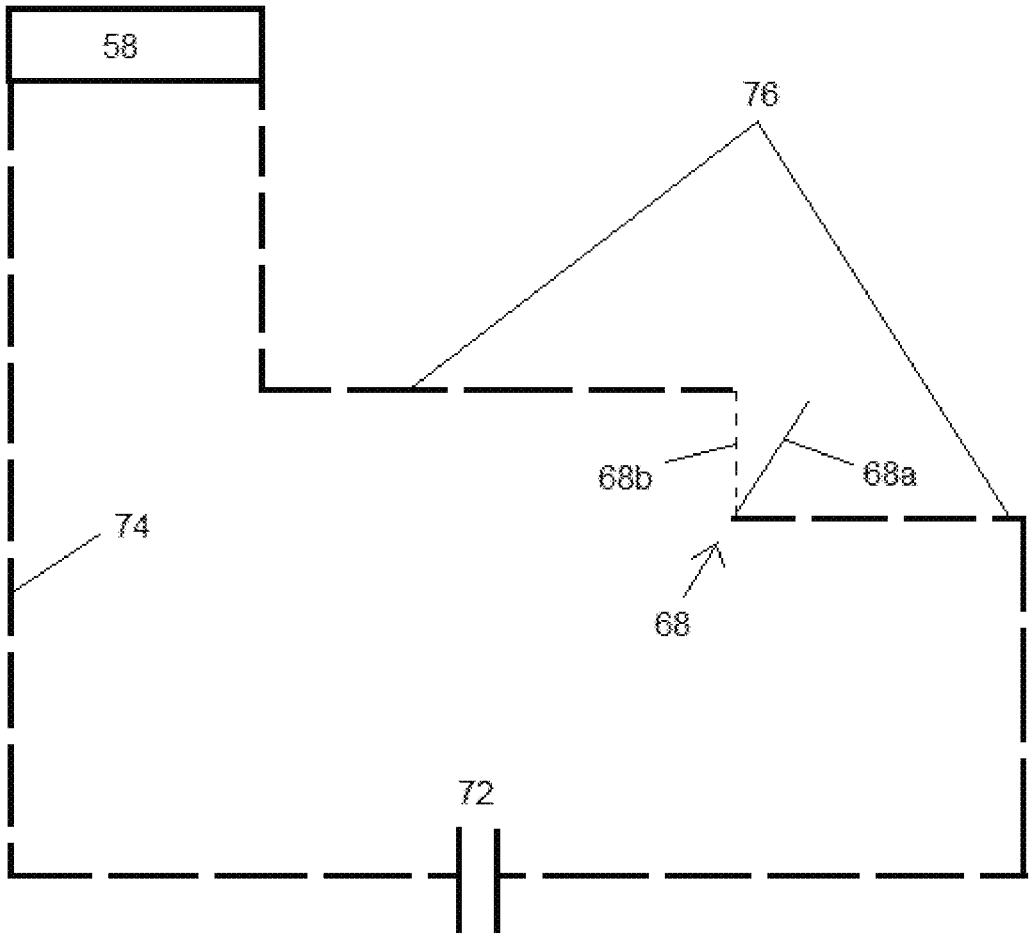
FIG. 3 is a wiring diagram of the electrical circuit of the humidifier of FIG. 2, in accordance with an example embodiment.

Based on the description above, it should also be understood that valve 58 may optionally be configured to open in a de-energized state (through the use of a "fail-open" valve, for instance), such that switch 68 could be configured to open circuit 76 (and therefore open valve 58) when the liquid level 64 of reservoir 62 is at a low level (see FIG. 3 for a more detailed description).

FIG. 3 is a wiring diagram of the electrical circuit of the humidifier of FIG. 2, in accordance with an example embodiment. The circuit may include a power source 72 (such as a DC source) connecting the first electrical circuit 76 to the second electrical circuit 74 to energize or de-energize valve 58. In particular, as described above, a low liquid level 64 of reservoir 62 (see FIG. 2) may cause switch 68 to move to a closed position 68*b* in order to energize the overall circuit 74/76 (and in turn energize valve 58 to an open position). A high liquid level 64 of reservoir 62 may cause switch 68 to move to an open position 68*a* in order to de-energize the overall circuit 74/76 (and in turn de-energize valve 58 to a closed position).

As stated above, it should be understood that valve 58 may alternatively be configured to open in a de-energized state (through the use of a "fail-open" valve, for instance), such that switch 68 could be configured to be moved to an open position 68*a* (and therefore open valve 58) when the liquid level 64 of reservoir 62 is at a low level, and switch 68 could be configured to be moved to a closed position 68*b* (which closes valve 58) when liquid level 64 of reservoir 62 is at a high level.

In an alternative embodiment, it should be understood that the actuation of valve 58 may be accomplished to allow for a spectrum of valve positions between fully opened and fully closed, based on the measured liquid level 64 in reservoir 64. That is to say, switch 68 may be configured to identify a number of liquid level positions, and based on this information the actuation of valve 58 may be adjusted using a spectrum of positions (e.g., "fully-open," "three-quarters open," "half-open," etc.) that match the need to replenish water in reservoir 62.

Figure 4:
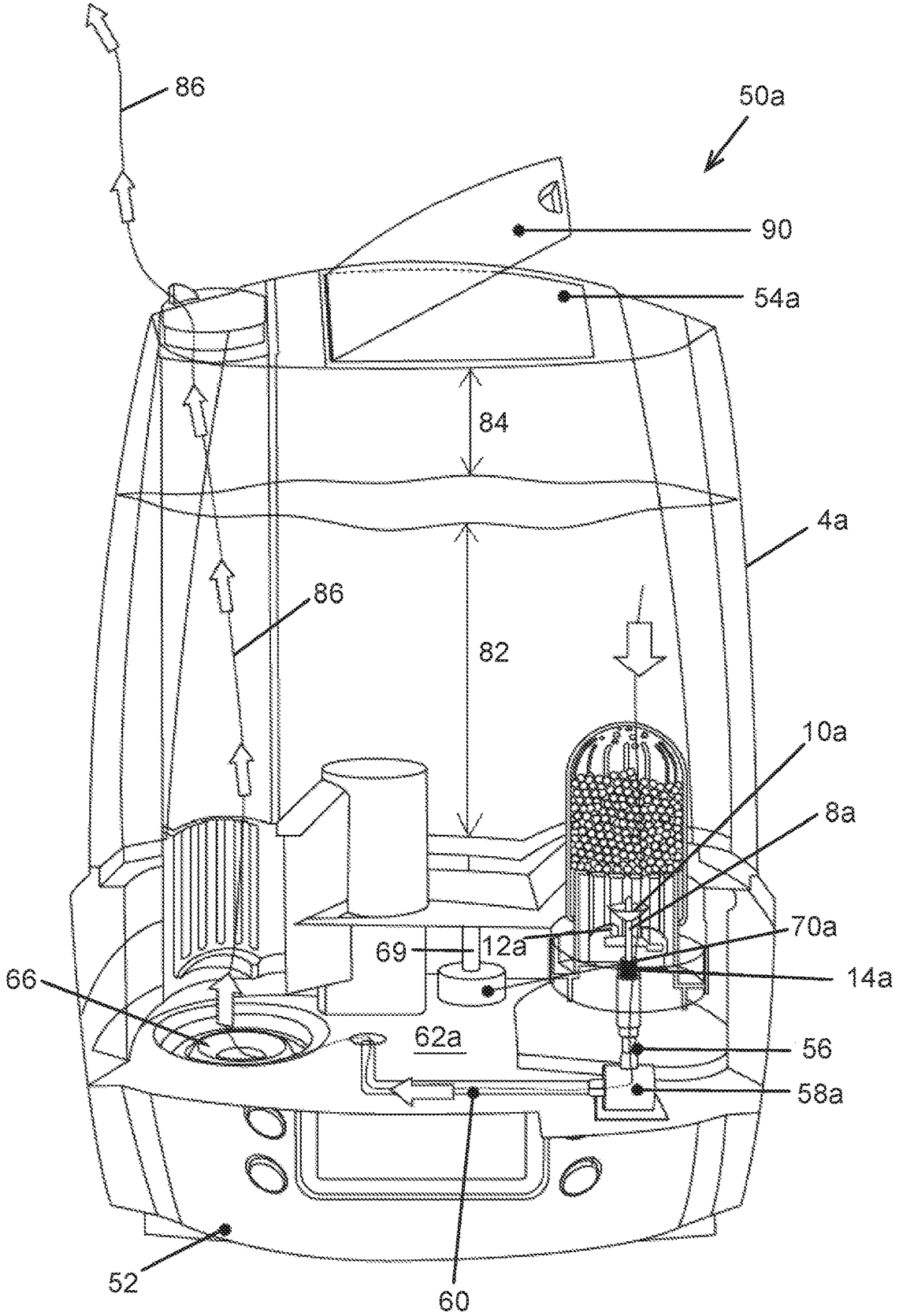
FIG. 4 is a humidifier, in accordance with an example embodiment.

FIG. 4 is a humidifier 50*a*, in accordance with an example embodiment. The humidifier 50*a* includes many of the same elements as shown in FIG. 2, and only those elements that differ from FIG. 2 are described herein.

The humidifier 50*a* may include an upper water tank 4*a* that may be either permanently affixed or detachable from base 52. The tank 4*a* may include a lid 90 allowing easy access to the tank 4*a* for convenient filling. A floater 70*a* may float on post 69 in order to open and close an electrical contact in order to activate a plunger-type solenoid valve 58*a*. Specifically, solenoid valve 58*a* may be used to force valve stem 8*a* and valve disk 10*a* upwards, such that disk 10*a* separates from valve seat 12*a*, in order to cause water from tank 4*a* to flow through channel 56 through tube 60 and into lower water reservoir 62*a*. When lower water reservoir 62*a* is full of water (as indicated by floater 70*a*), spring 14*a* may work in conjunction with solenoid valve 58*a* to force valve disk 10*a* back down onto valve seat 12*a* to cease the flow of water through channel 56 and tube 60.

Figure 5:
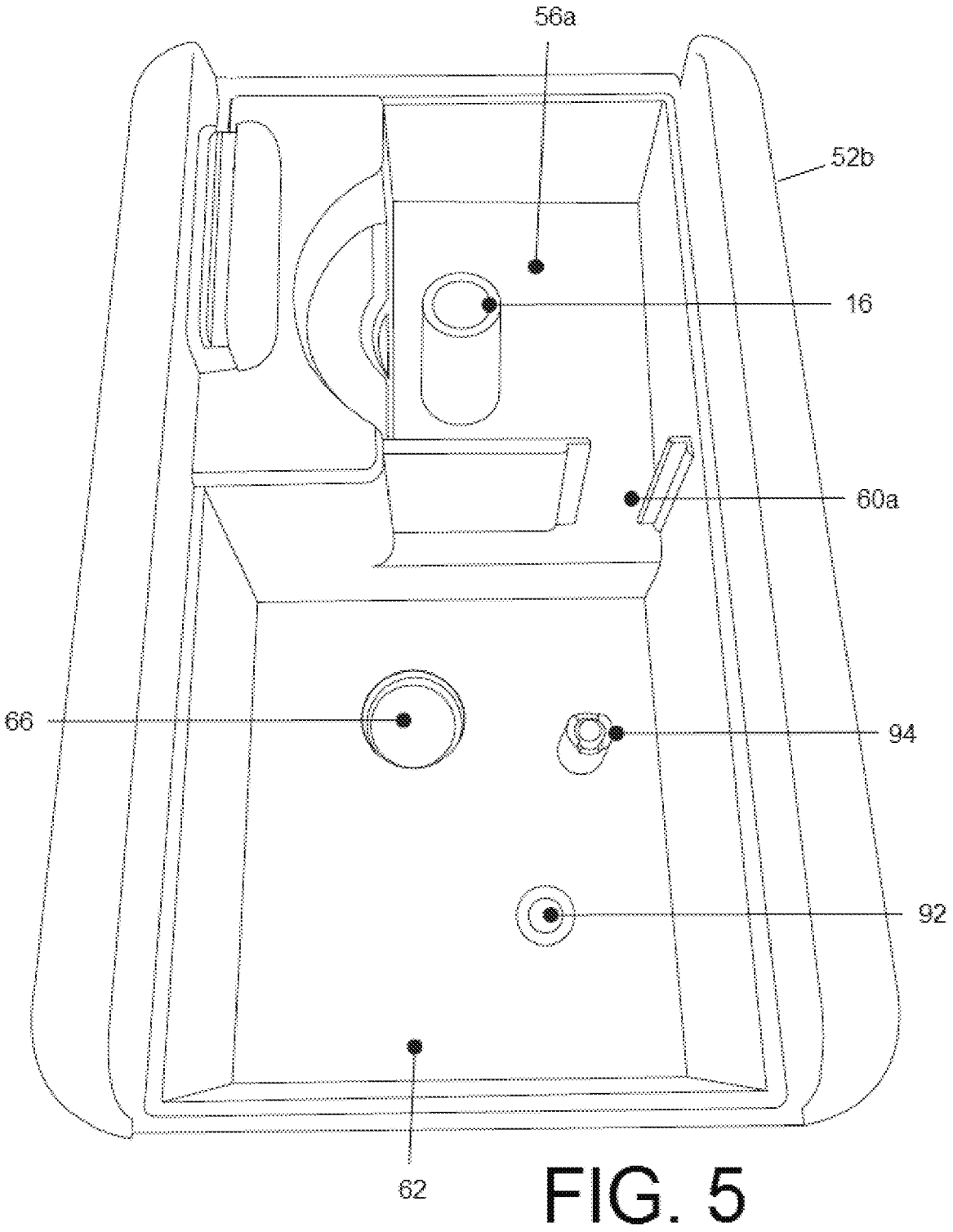
FIG. 5 is a cut-away view of a base of a humidifier, in accordance with an example embodiment.

FIG. 5 is a cut-away view of a base 52*b* of a humidifier, in accordance with an example embodiment. The base 52*b* may include an upper water channel 56*a* that may fill with water due to the activation of a solenoid valve 58*a* (shown in FIG. 4, but not explicitly shown in FIG. 5). Water flows from channel 56*a* through water passage 60*a* into lower reservoir 62 and into nebulizer 66.

In this embodiment, a conductive post 94 may be used to determine water level in lower reservoir 62. The conductive post 94 is shown in more detail in FIGS. 6A and 6B. An LED light 92 may be located at the bottom of lower reservoir 62, and may be activated to turn on and illuminate during the presence of water in reservoir 62.

Figure 6A:
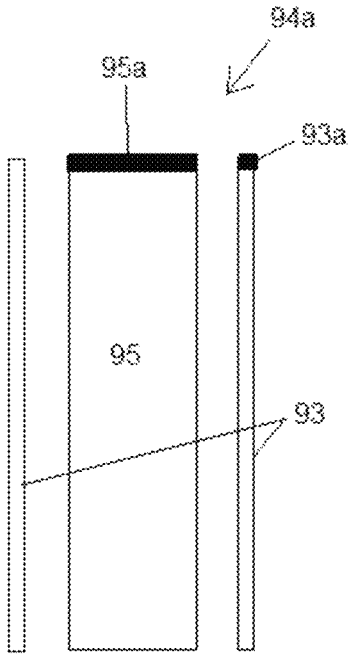
FIGS. 6A and 6B are diagrams of a conductive post, as shown in FIG. 5, in accordance with an example embodiment.
Figure 6B:
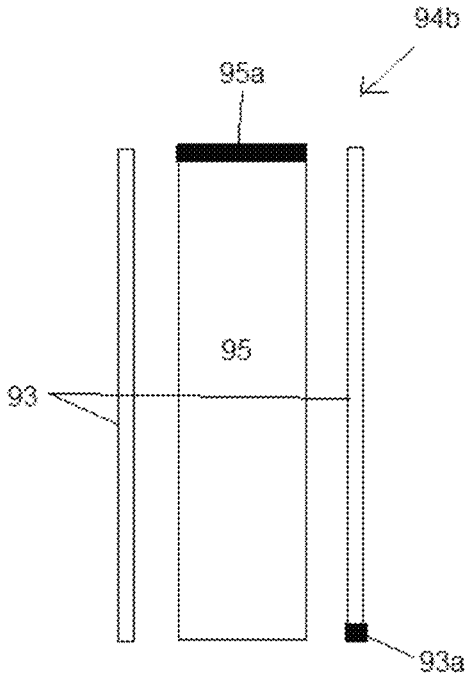

FIGS. 6A and 6B are diagrams of conductive posts 94*a/b*, as shown in FIG. 5, in accordance with an example embodiment. Each conductive post 94*a/b* may include a central post 95 surrounded by a casing 93. A first electrical contact 95*a* may be on the central post 95, and a second electrical contact 93*a* may be on the casing 93. The electrical contacts 93*a*/95*a* may be made from copper, or another suitable metal that is electrically conductive. The electrical contacts 93*a*/95*a* may be plated to prevent corrosion. These electrical contacts 93*a*/95*a* may be electrically energized. As water fills lower reservoir 62 of the humidifier (see FIG. 5), the water may close an electrical circuit between the electrical contacts 95*a* and 93*a* in order to complete an electrical circuit (in the same fashion as electrical circuit shown in FIG. 3) in order to cause solenoid 58*a* to cause valve disk 10*a* to lower onto the valve seat 12*a* to stop a flow of water from entering lower reservoir 62. A height of post 95 (or, more specifically, a height of contact 95*a* on post 95) may correspond to a desired liquid level of liquid within reservoir 62.

Figures 7A, 7B:
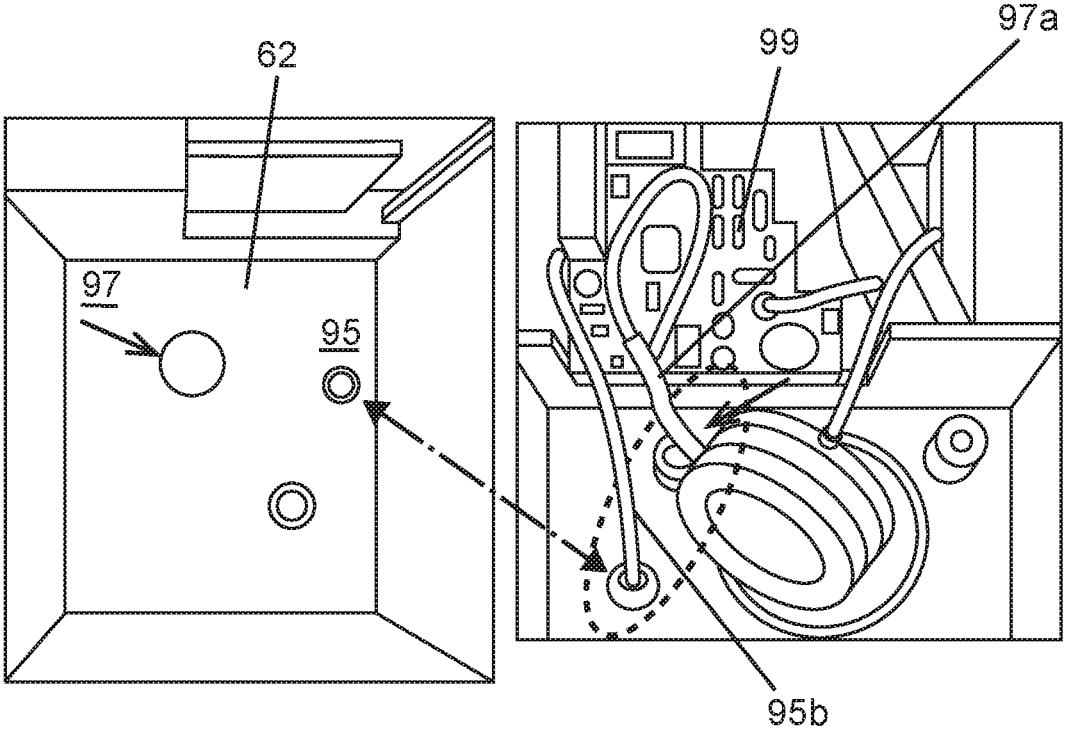
FIGS. 7A and 7B are diagrams of an alternative conductive post, as shown in FIG. 5, in accordance with an example embodiment.

FIGS. 7A and 7B are diagrams of an alternative conductive post 95, as shown in FIG. 5, in accordance with an example embodiment. The post 95 may include a top-portion that is made from copper, or another suitable metal that is electrically conductive. The electrically conductive top-portion of the post 95 may be plated to prevent corrosion. The top-portion of post 95 may be electrically connected to a printed circuit board (PCB) 99 that may be configured to identify when lower water reservoir 62 is filled with water. Specifically, PCB 99 may also be electrically connected to an ultrasonic disc 97. By electrically energizing the top-portion of post 95, the existence of water within lower reservoir 62 may close an electrical circuit between the ultrasonic disc 97 and the top-portion of the conductive post 95 in order for PCB 99 to identify the presence of water within reservoir 62. A height of post 95 (or, more specifically, a height of the electrically conductive top-portion of post 95) may correspond to a desired liquid level of liquid within reservoir 62.

Figure 8:
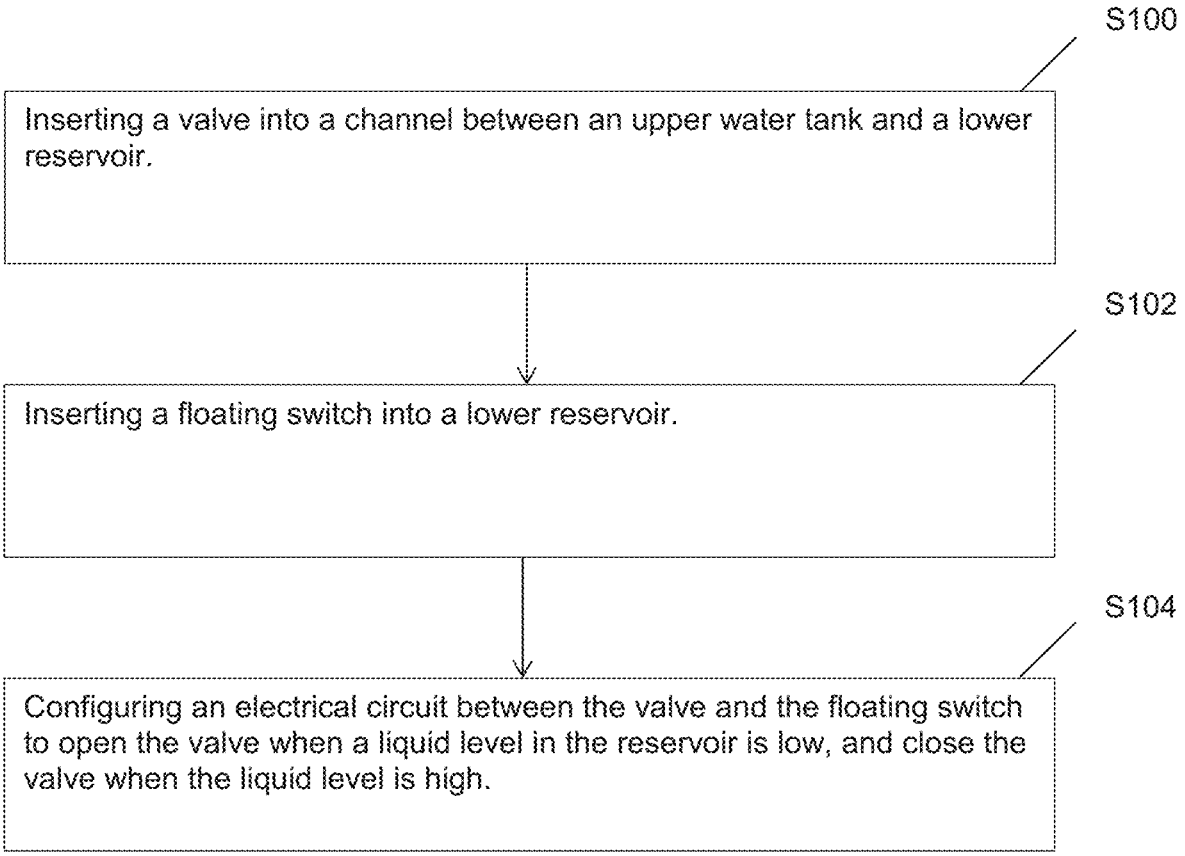
FIG. 8 is a flowchart of a method of making a humidifier, in accordance with an example embodiment.

FIG. 8 is a flowchart of a method of making a humidifier 50, in accordance with an example embodiment. The method may include a step S100 of inserting a valve 58 into a channel 56 between an upper water tank 54 and a lower reservoir 62 (see FIG. 2). In step S102, a floating switch 68 may be inserted into the lower reservoir 62. In step S104, an electrical circuit 74/76 may be configured between the valve 56 and switch 68 so that valve 58 opens when the switch 68 indicates a low liquid level 64 in reservoir 62, and closes when switch 68 indicates a high liquid level 64 in reservoir 62.

Figure 9:
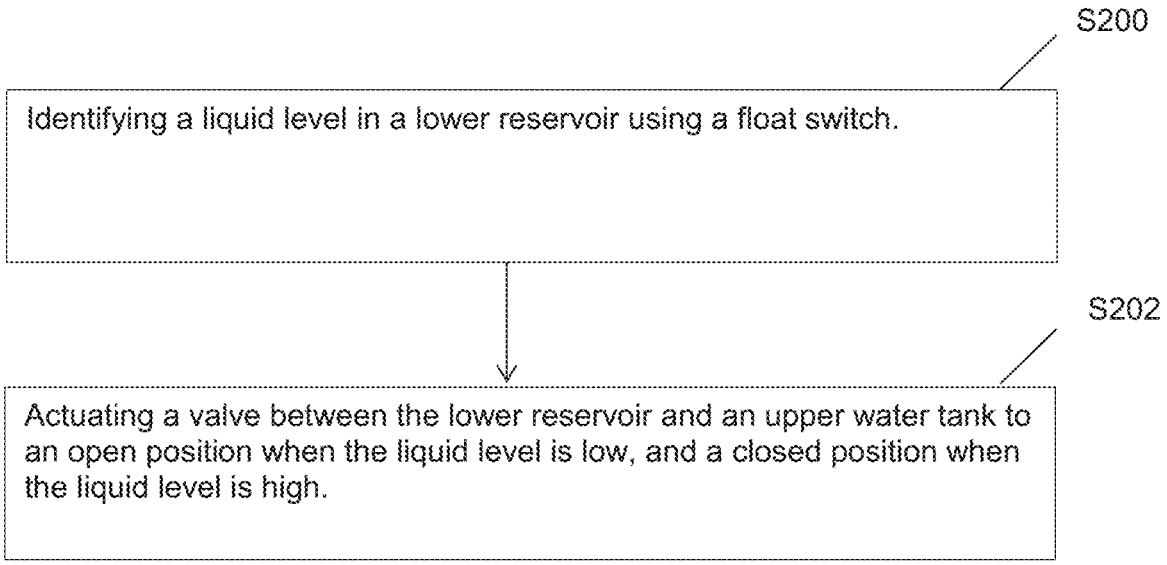
FIG. 9 is a flowchart of a method of using a humidifier, in accordance with an example embodiment.

FIG. 9 is a flowchart of a method of using a humidifier 50, in accordance with an example embodiment. The method may include a step S200 of identifying a liquid level 64 in a lower reservoir 62 using a float switch 68 (where the switch 68 may indicate a low liquid level and a high liquid level, for instance). In step S202, a valve 58 located between the lower reservoir 62 and an upper water tank 54 may be actuated to an open position when a liquid level 64 is low, and may be actuated to a closed position when a liquid level 64 is high.

Example embodiments having thus been described, it will be obvious that the same may be varied in many ways. Such variations are not to be regarded as a departure from the intended spirit and scope of example embodiments, and all such modifications as would be obvious to one skilled in the art are intended to be included within the scope of the following claims.

What is claimed is:

1. A humidifier, comprising:

a passage fluidly connecting an upper tank to a lower reservoir;

a switch in the lower reservoir, wherein the switch is a conductive post comprising at least two electrical contacts and configured to measure a liquid level in the lower reservoir, wherein one of the at least two electrical contacts of the conductive post is positioned near a top portion of the conductive post; and a valve in the passage, wherein the switch is configured to electrically connect the valve with a power source via the at least two electrical contacts such that the valve is configured to open the passage via power supplied by the power source in response to detecting that water in the lower reservoir closes an electrical circuit between the at least two electrical contacts and the power source thereby indicating a low liquid level in the lower reservoir, and the valve being configured to close the passage in response to detecting that the at least two electrical contacts open the electrical circuit thereby indicating a high liquid level in the lower reservoir, wherein a height the conductive post corresponds to the high liquid level of the lower reservoir.

2. The humidifier of claim 1, wherein the upper tank is unsealed such that air in the upper tank is allowed to equalize with an ambient air pressure.

3. The humidifier of claim 1, wherein the upper tank is permanently affixed to a base of the humidifier.

4. The humidifier of claim 1, wherein the humidifier is top-filled such that the upper tank is configured to accept water from a top connection on the upper tank.

5. The humidifier of claim 1, wherein the electrical circuit is positioned between the valve and the switch; and the humidifier further comprises a power source configured to energize the electrical circuit to open the valve in response to detecting the low liquid level in the lower reservoir.

6. The humidifier of claim 5, wherein the switch is a float switch capable of floating within the lower reservoir, the float switch being configured to change the energy state of the electrical circuit in order to open the valve if the float switch floats to a position that is the low liquid level in the lower reservoir.

7. The humidifier of claim 1, wherein the at least one two electrical contacts are configured to change the energy state of the electrical circuit if a water level in the lower reservoir is at the low liquid level.

8. The humidifier of claim 1, wherein the valve is a solenoid valve.

9. The humidifier of claim 8, wherein the solenoid valve is one of a plunger solenoid valve and a pivoting-armature solenoid valve.

10. The humidifier of claim 1, wherein the upper tank is detachable from the remainder of the humidifier.

11. The humidifier of claim 1, wherein the switch is configured to measure a spectrum of liquid levels in the lower reservoir, the valve is further configured to open to one of a spectrum of positions between fully-opened and fully-closed based on the measurement of the spectrum of liquid levels from the switch.

12. The humidifier of claim 1, wherein the conductive post comprises a central post surrounded by a casing, and the at least two electrical contacts are positioned on the central post and the casing, respectively.

* * * * *